US005127525A

United States Patent [19]

Hummer

[11] Patent Number: 5,127,525

[45] Date of Patent: Jul. 7, 1992

[54] NON-UNIFORMLY SHAPED ARTICLE STABILIZING CONTAINER APPARATUS

[75] Inventor: Katherine M. Hummer, Osceola, Ind.

[73] Assignee: Stone Container Corporation, Chicago, Ill.

[21] Appl. No.: 613,237

[22] Filed: Nov. 14, 1990

[51] Int. Cl.[5] ..... B65D 81/14

[52] U.S. Cl. ..... 206/586; 206/588; 206/594; 229/87.02

[58] Field of Search ..... 206/521, 583, 586, 588, 206/591, 592, 593, 594; 229/87.01, 87.02, 87.15

[56] References Cited

U.S. PATENT DOCUMENTS 1,676,238 7/1928 Batty ..... 229/87.01
2,755,982 7/1956 Vander Lugt, Jr. ..... 206/334 X
3,036,754 5/1962 Kleingers, Jr. ..... 206/588 X
3,211,283 10/1965 Hassler ..... 206/594 X
4,562,952 1/1986 Chinman ..... 229/87.15
4,865,200 9/1989 Sullivan et al. ..... 206/583

*Primary Examiner*—Bryon P. Gehman
*Attorney, Agent, or Firm*—Dick and Harris

[57] ABSTRACT

An article stabilizing container apparatus for the envelopment and restraint of one or more non-uniformly shaped articles therewithin for the protection of the article during shipment. One or more inner article containment members encase and encircle the article, serving to suspend and restrain the article within an outer articulatable container, when the outer container is locked into its closed position. A portion of the one or more inner article containment members is restrainably attached to a portion of the outer articulatable container to further preclude front-to-back, up and down and side-to-side movement of the enclosed article.

16 Claims, 4 Drawing Sheets

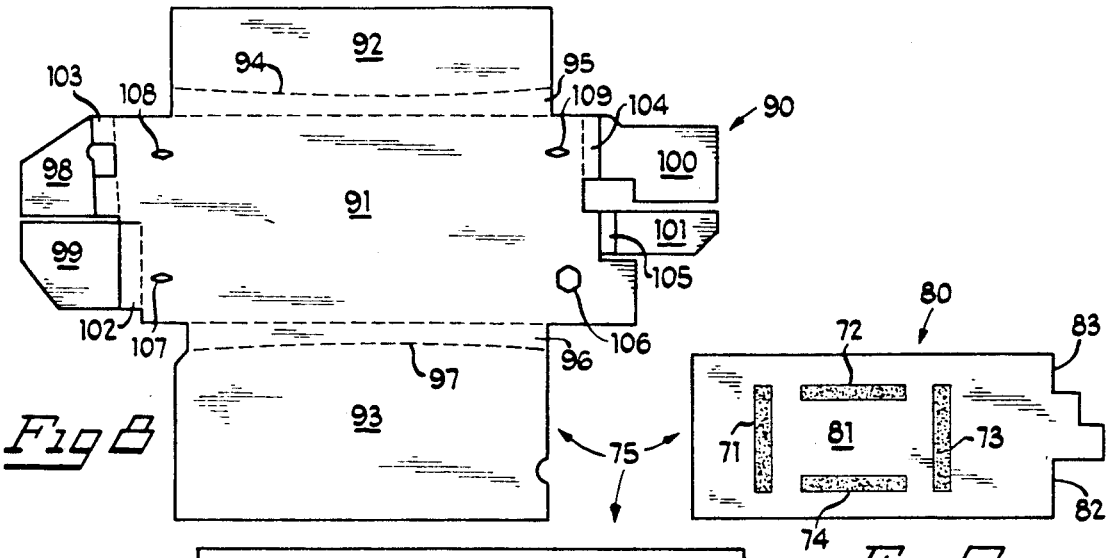
Fig 8
Fig 9
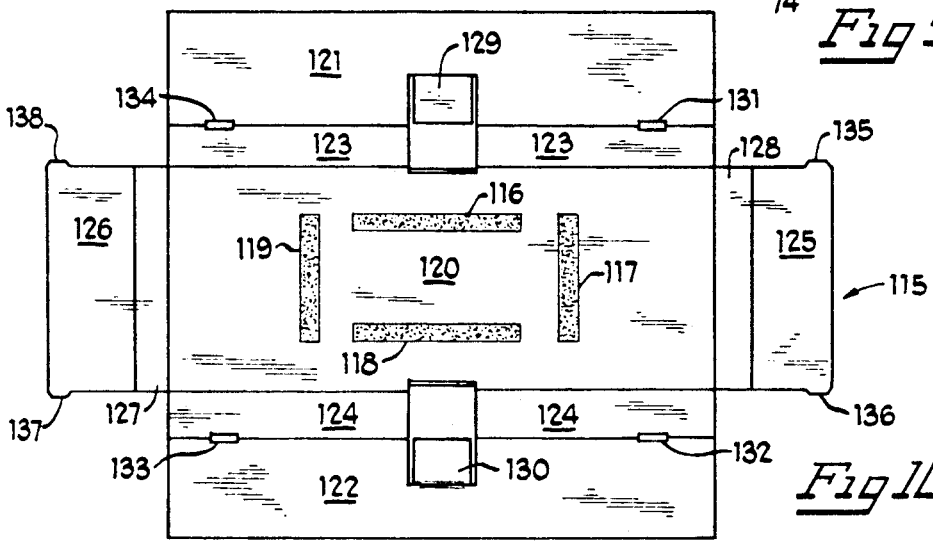
Fig 10
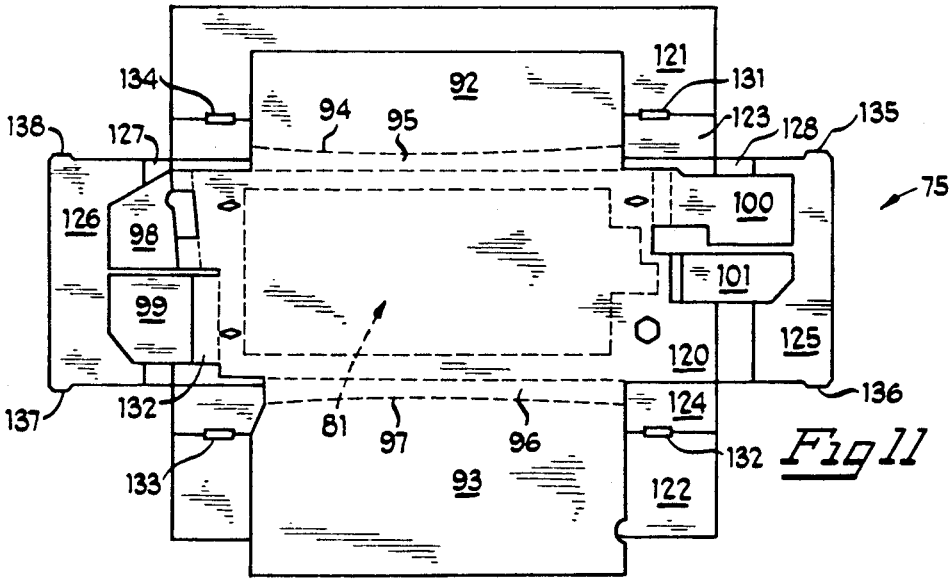
Fig 11

NON-UNIFORMLY SHAPED ARTICLE STABILIZING CONTAINER APPARATUS

BACKGROUND OF THE INVENTION

The present invention relates in general to shipping or storage containers for securing and protecting non-uniformly shaped articles during shipment and in particular, to an article stabilizing container apparatus for keeping such articles sealed and protected during transportation by enveloping and restraining non-uniformly shaped articles therewithin.

Shippers of articles need to ensure that a shipped article will arrive at its destination in a safe and secure manner. A broken or dented article is often of little use to the recipient-and substantially increases costs. If the damage to the article has occurred during shipping, the shipper will typically be responsible for the damage.

In order to protect the article during shipping, shippers often utilize shipping materials that absorb the shocks to the packing carton that the article is shipped in. To ideally absorb such shocks to the packing carton, the article is preferably positioned in the center of the carton--to minimize contact between the article and the exterior walls of the shipping carton.

To obtain this positioning of the article within the shipping carton, shippers have utilized many different devices. A common technique has involved the use of polystyrene plastic or paper material known as "popcorn" or "filler". Shippers often fill a carton with a layer of this popcorn and then place the article within the carton. They then fill the remaining space within the carton so as to have the article surrounded by the popcorn. Due to the shock absorbing nature of the polystyrene plastic popcorn, sharp shocks or bumps to the carton are substantially absorbed by the popcorn and not transmitted to the article. While adequate for the purpose, the use of such popcorn or filler presents some problems. In application, for example, the popcorn may easily shift and therefore there is little guarantee that the article will remain fully encircled by the popcorn to maintain little contact with the external walls of the carton itself. Where the orientation of the article itself may shift during shipping and/or storage, more fragile portions of a non-uniformly shaped object may be prone to damage, or cause puncture or tearing of the box, with loss of contents.

An alternative way that shippers achieve shock absorption is through the use pre-shaped polystyrene plastic blocks positioned within the carton in such a way so that the article is restrained from moving within the carton. The foam blocks can be reconfigured for each differently shaped article, or, as known for electronic components, may be shaped to fully enclose the article. However, the effort needed and utilized to position and restrain either a pair of mated fully enclosing foam blocks or a number of smaller, spacer blocks into the appropriate position can raise the cost of shipping and packing substantially. This is especially true of pre-shaped enclosing styrofoam which is specifically shaped to accept a particularly shaped article—requiring inventorying of a number of styrofoam shapes. Additionally, unlike popcorn filler, the smaller polystyrene blocks do not guarantee a full enclosure of all sides of the article so that it is possible that a shock could be applied from a direction which a block will not absorb.

With the current trend towards recyclability and the use of biodegradable products, polystyrene plastic or styrofoam products has been greatly discouraged. In some communities, the use of non-biodegradable products have been banned altogether making it impossible for shippers utilizing such methods of shipment to conduct business within these communities.

It is thus an object of the present invention to provide an article stabilizing container apparatus that can be utilized on various non-uniformedly shaped articles.

It is additionally an object of the invention to form an article stabilizing container apparatus out of a minimum number of recyclable materials so that the apparatus can be brought into most communities.

It is further an object of the present invention that the apparatus be economical due to the elimination of a great number of component packaging parts and effort necessary to form the apparatus—while providing an apparatus that avoids pre-shaped plastic parts and which minimizes the number of specially shaped components which co-operate with non-uniformly shaped articles. Such an object includes the use of a changeable packaging element with a uniform outer element.

It is additionally an object of the invention to further protect and isolate articles within the apparatus so as to substantially cushion the article from external shocks and bumps during transportation of the apparatus and article, by suspending the article within the container with air pockets formed in various regions.

It is still further an object of the invention to have easy and substantially full access to the article within the apparatus upon disarticulation of the apparatus by removal of a single package confining element.

These and other objects of the invention will become apparent in light of the present specification and drawings.

SUMMARY OF THE INVENTION

The present invention comprises an article stabilizing container apparatus for sealing and protecting articles within the apparatus during transportation and storage.

In a preferred embodiment of the invention, the apparatus comprises one or more inner article containment members. These inner article containment members are formed from a substantially planar platform that has a top surface and a bottom surface opposite to the top surface. This platform is attachable to the article being protected, and substantially configured so as to at least partially restrain the movement of the article. This configuration of the platform relative to the dimensions of the article will leave at least a portion of the bottom surface of the platform exposed.

The apparatus also comprises an outer articulatable container having a bottom panel member, one or more cover panel members that are positioned opposite to the bottom panel member and one or more side panel members. The bottom panel member of the outer articulatable container also has a top and bottom surface and at least one side edge from which the one or more side panel members emanate. The side panel members have an upper edge and a lower edge opposite to the upper edge. This lower edge of the side panel members emanates from the bottom panel member of the outer articulatable container thereby forming the side panel folds on which the side panel members hinge. The cover panel members emanate from the side panel members. Positioned opposite to the bottom panel member, the cover panels hingedly emanate from the upper edges of the one or more side panel members thereby forming a cover panel fold.

The one or more inner article containment members and the outer articulatable container are attached to each other at their respective platform and bottom panel members. The exposed area of the bottom surface of the platform is attached to the top surface of the bottom panel member of the outer articulatable container by a container attachment member. This securement of the one or more inner article containment members to the outer articulatable container, facilitates and ensures that the article confined by the one or more inner article containment members is restrained and suspended within the outer articulatable container so as to decrease the article's movement in either the front to back, side to side and up and down directions, through creation of a series of air pockets within the apparatus, adjacent the article.

The apparatus is further secured by an outer container closure that will further restrain the one or more inner article containment members and thereby the article within them. This outer container closure member further serves to ensure that the outer articulatable container will remain closed and deployed during the shipping and storage of the apparatus.

In a preferred embodiment of the invention, the outer articulatable container means further includes a front panel member and a back panel member opposite to the front panel member, both of which hingedly emanate from the respective front and back edges of the outer articulatable container. These front and back panel members have respective upper edges from which front and back panel closure flaps respectively emanate. The front and back panel closure flaps are folded inwardly towards the one or more inner article containment members so as to further enclose and secure the one or more inner article containment members and the articles constrained therein. The front and back closure flap members are held in place by front and back panel securement elements. This securement may be accomplished by an interference, friction fit between the edge of the front and back panel closure flaps and the side or cover panels of the outer articulatable container. Preferably, this securement may be achieved by tab-aperture locking elements; the tab being positioned on the edges of the front and back panel closure flaps while the apertures are operably positioned on either of the side panels or the cover panels of the outer articulatable container and aligned so as to operably engage and co-operate with the tabs, thereby securing the position of the front and back closure flaps and the front and back panel members. When utilized in combination with the cover panel members, the one or more inner article containment members are substantially encircled by the outer articulatable container.

In another preferred embodiment, the one or more inner article containment members have one or more side walls hingedly emanating from the platform at the side edges of the platform. These side walls have respective upper edges from which one or more top walls hingedly emanate from top wall folds. The top walls are used to cover at least a portion of the article within the one or more inner article containment members so as to more securely restrain the position of the article within the one or more containment members, such as by bearing down on the article after closure of the overall apparatus. Additionally, the outer articulatable containment member further includes bearing flaps located within any of the cover or side panels. These bearing flaps are hinged so that when utilized properly deployed and restrained by the closure means, they apply pressure to the side and/or top walls of the one or more inner article containment members and thereby constrict the one or more inner containment members, to further restrict the movement of the article therewithin.

In the preferred embodiment, the one or more inner article containment means comprises a single inner article containment member. This inner article containment member further comprises two side walls emanating from the opposite side edges of the platform. Similarly, the top walls consist of two top wall members that enclose at least a portion of the article within the inner article containment member, and the outer articulatable container member includes front and back panel members positioned opposite to each other and emanating from the front and back edges, respectively, of the bottom panel. The front and back closure flaps hingedly emanate from the respective upper edges of the front and back panels members and are directed inwardly towards the inner article containment member so that, upon full articulation of the apparatus, the inner article containment member is more securely restrained therewithin. The front and back closure flaps are locked in place by securement members that help ensure that the outer articulatable container remains restrainably deployed. The cover panel members are formed by two cover panels positioned opposite to each other and substantially parallel with the two top wall members of the inner article containment member. When used in conjunction with the front and back panel closure flaps, the cover panel members substantially, further enclose the inner article containment member and thereby the article within.

The apparatus is securely closed by an outer container closure member that is operably positioned to engage the bearing flaps of the outer articulatable container. The combination of the outer container closure member and the bearing flaps substantially increase the restraint of the outer container against the inner article containment member and, in turn, the article within, by applying pressure through the bearing flap to the side and/or top walls of the inner article containment member.

In the preferred embodiment the top wall folds of the inner article containment member are substantially curvilinear in shape so as to create a narrower, pinching side wall shape near the center of the inner article containment member and article. This narrowing of the side walls towards the center of the inner article containment member, provides a crimping action and thereby allows the inner article containment member to more closely conform to the unique shape of the article—to more securely restrain the article within the inner article containment member than would otherwise be possible. To further effectuate this crimping of the inner article containment member, the bearing flaps and the outer container closure member of the apparatus will be located proximate to the center of the apparatus at the narrowest point of the side walls of the inner article containment member. Alternatively, the article may be secured by the inner article containment member being merely substantially conformed to the outer perimeter peripheral shape of the article, rather than the narrowing effect of the top wall fold and corresponding tapered side wall.

In another preferred embodiment, the apparatus comprises first and second inner article containment members, each inner article containment member comprising at least a platform member with a top and bottom surface. The top surface of the first inner article containment member is attached adhesively to the bottom surface of the second inner article containment member. The bottom surface of the platform member of the first inner article containment member is then further attached and restrained to the top surface of the bottom panel of the outer articulatable container whereby the first and second inner article containment members are further secured within the apparatus. Both the first and second inner article containment members are formed so as to accommodate and stabilize portions of a non-uniformly shaped article so as to be preclude shifting and/or damage during shipment and/or storage within the article stabilizing container apparatus. For example, the second inner article containment member may effectively add height or padding to the position of the article to isolate from damage, a protruding element, such as a downwardly protruding pin formed in the article.

The closure members preferably comprise a band or strap member wrapped about said outer articulatable container member so as to engage the bearing flaps which, in turn, engage the side and/or top walls of the inner article containment member. Preferably, the band member will be comprised from a metallic strap material so as to more readily restrain the closed formation of the apparatus during usage. Upon cutting of the band alone, immediate access to the article—without substantial unwrapping efforts.

While the apparatus may be formed from any number of materials, the preferred material for the apparatus is corrugated paper-board. In this embodiment, each of the inner article containment members and the outer articulatable container are formed out of independent corrugated paper-board blanks. In this embodiment further, the container attachment means through which the bottom surface of the platform of the inner article containment member and the top surface of the bottom panel of the outer articulatable container are attached, comprises a suitable, paper to paper bonding adhesive.

BRIEF DESCRIPTION OF THE DRAWINGS

FIG. 8 of the drawings is a top plan view of a first inner article containment means made from a uniform board of corrugated paper board material;

FIG. 9 of the drawings is a top plan view of a second inner article containment means formed from a single unitary sheet of corrugated paper board material;

FIG. 10 of the drawings is a top plan view of the outer articulatable container means being formed from a unitary sheet of corrugated paper board material prior to articulation;

FIG. 11 of the drawings is a top plan view of the article stabilizing container apparatus of FIGS. 8, 9 and 10 wherein the first and second inner article containment means are operably positioned within the outer articulatable container means for receipt of the article prior to articulation, deployment and closure of the article stabilizing container apparatus.

DETAILED DESCRIPTION OF THE DRAWINGS

Figure 1:
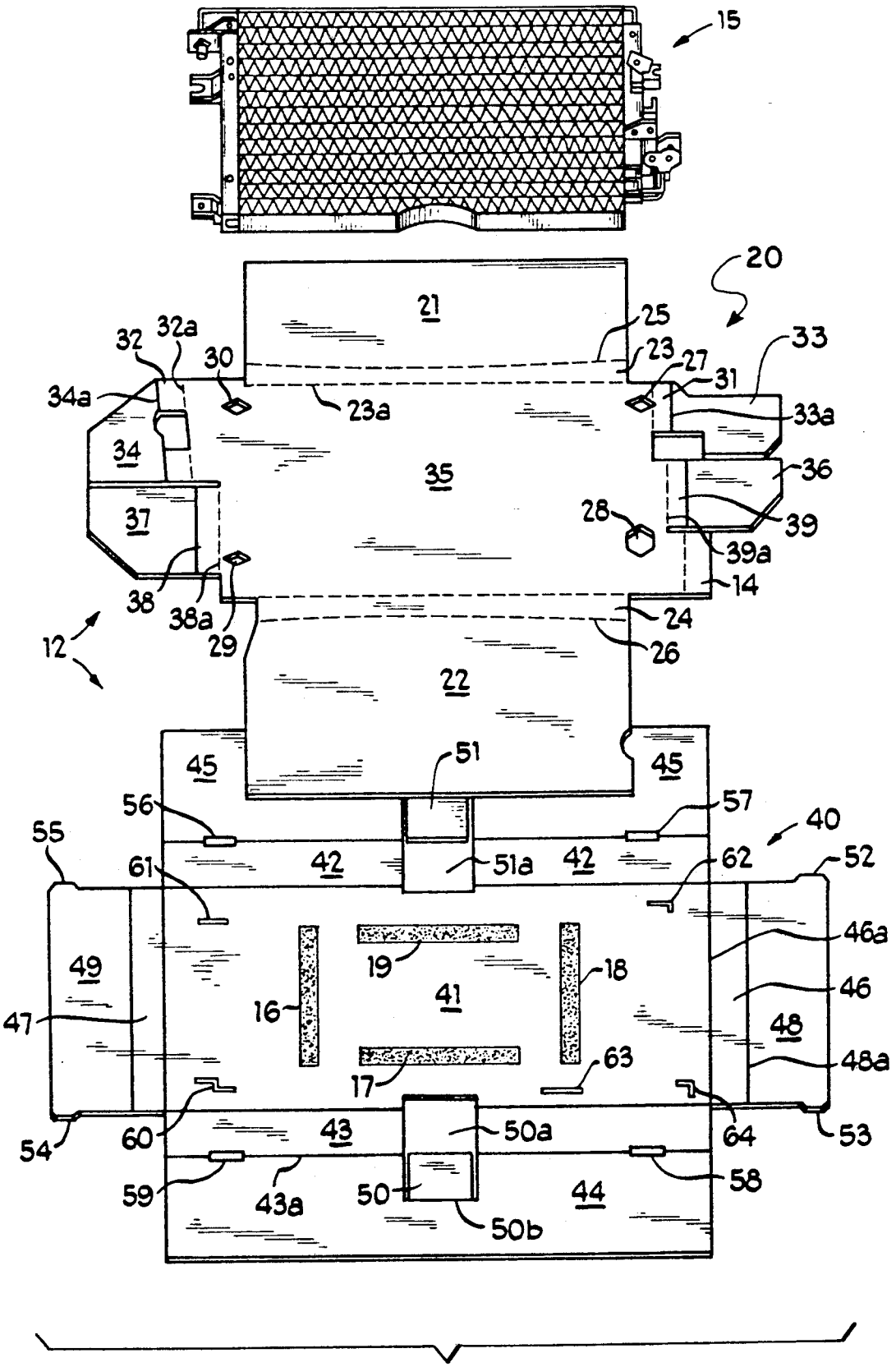
FIG. 1 of the drawings is an exploded perspective view of the non-articulated article stabilizing apparatus comprising two single unitary sheets of corrugated paper board material prior to articulation into the apparatus and prior to envelopment of the article.

While this invention is susceptible of embodiment in many different forms, there is shown in the drawings and will herein be described in detail, several specific embodiments, with the understanding that the present disclosure is to be considered as an exemplification of the principals of the invention and is not intended to limit the invention to the embodiments illustrated.

The non-deployed and non-articulated article stabilizing container apparatus 12, along with a non-uniformly shaped automotive condenser 15, is shown in FIG. 1. Apparatus 12 comprises inner article containment means 20 and outer articulatable container means 40. Inner article containment means 20 comprises a substantially planar platform 35 and side wall means 23 and 24 which are hingedly emanating from platform 35 from side edges such as side edge 23*a*. Additionally, top wall means 21 and 22 hingedly emanate from side wall means 23 and 24 at top wall fold means 25 and 26. Top wall fold means 25 and 26 are preferably scored in a substantially curvilinear shape—so as to facilitate a narrowing of side wall means 23 and 24 to thereby exert a crimping action about automotive condenser article 15 when top wall means 21 and 22 are fully articulated and closed. Also emanating from platform 35 at front and back edge means such as edges 39*a*, 38*a* and 32*a*, are front and back wall means 31, 39, 14, 38 and 32 respectively. Front and back lid means 33, 36, 37 and 34 hingedly emanate from front and back wall means 31, 39, 38 and 32 respectively, along front and back lid fold means such as folds 33*a* and 34*a*. Additionally, platform 35 contains apertures 27 through 30 for receiving and isolating fragile portions of condenser article 15 so as to better protect and suspend condenser 15 and its components within apparatus 12, while isolating those components from damage.

Outer articulatable container means 40 as shown in FIG. 1, comprises bottom panel means 41, side panel means 42 and 43, front and back panel means 46 and 47 as well as cover panel means 45 and 44. Front and back panel means 46 and 47 hingedly emanate from bottom panel means 41 along front and back panel edges such as panel edge 46*a*. Additionally, front and back closure flap means 48 and 49 hingedly emanate from front panel means 46 and 47 along respective upper edges such as upper edge 48*a*. Side panel means 42 and 43 also hingedly emanate from bottom panel means 41 from respective side edges. Cover panel means 45 and 44 are attached to side panel means 42 and 43 along cover panel fold means such as fold 43*a*, positioned at the upper edge of side panel means 42 and 43. Cover panel means 45 and 44 contain bearing flap means 51 and 50 which are hinged at folds 51*b* and 50*b* respectively, and which when articulated and deployed, properly engage the side and top wall means 21 through 24 of inner article containment means 20. Front and back panel securement means are formed by tab securement members 52 through 55 and corresponding apertures 57, 58, 59 and 56. The tabs are positioned on the front and back panel closure means 48 and 49, while the apertures are formed in the side panel means 42 and 43 and cover panel means 45 and 44, of outer articulatable container means 40. When deployed and articulated in the fully closed position, tabs 52, 53, 54 and 55 will operably engage apertures 57, 58, 59 and 56, positioned within side panel means 42 and 43 and cover panel means 45 and 44, to preclude disengagement of the articulated outer container. Platform 41 further contains glue strips 16, 17, 18 and 19 to attach the top surface of bottom panel 41 to the bottom surface of platform 35 of inner article containment means 20, to, in turn, form secure article suspending apparatus 12.

Figure 2:
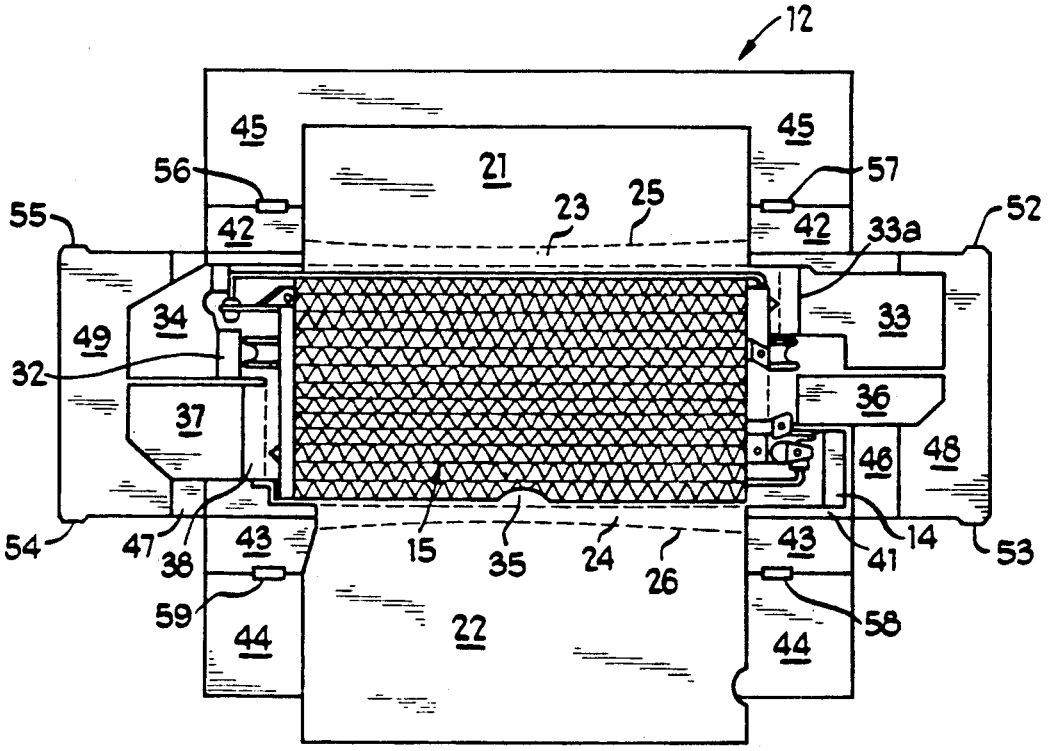
FIG. 2 is a top plan view of the article stabilizing container apparatus as the article is positioned within the inner article containment means positioned within the outer container means.

As shown in FIG. 2, article stabilizing container apparatus 12 is assembled so that glue strips 16, 17, 18 and 19 positioned on bottom panel means 41 are engaging platform 35 of inner article containment means 20 which receives placement of automotive condenser article 15 upon platform 35. In this initial stage of assembly, top wall means 21 and 22 can be seen as overlapping cover panel means 45 and 44 and side panel means 42 and 43. Additionally, front and back lid means 33, 36, 34 and 37 are also overlapping and engaging front and back panel means 46 and 47 as well as front and back closure flap means 48 and 49. Platform 35, side wall means 23 and 24, top wall means 21 and 22, front and back wall means 31 and 39 (from FIG. 1) and 14, 38 and 32, and front and back lid means 33, 36, 37 and 34, are all substantially co-planar prior to articulation, when top wall fold means 25 and 26, front and back lid fold means 33*a* and 34*a* front and back edge means 39*a* and 32*a*, as well as side edges 23*a* are substantially non-folded. Similarly, bottom panel means 41, side panel means 42 and 43, cover panel means 45 and 44, front and back panel means 46 and 47, as well as, front and back closure flap means 48 and 49 are also substantially co-planar to each other and parallel to inner article containment means 20, prior to articulation.

Figure 3:
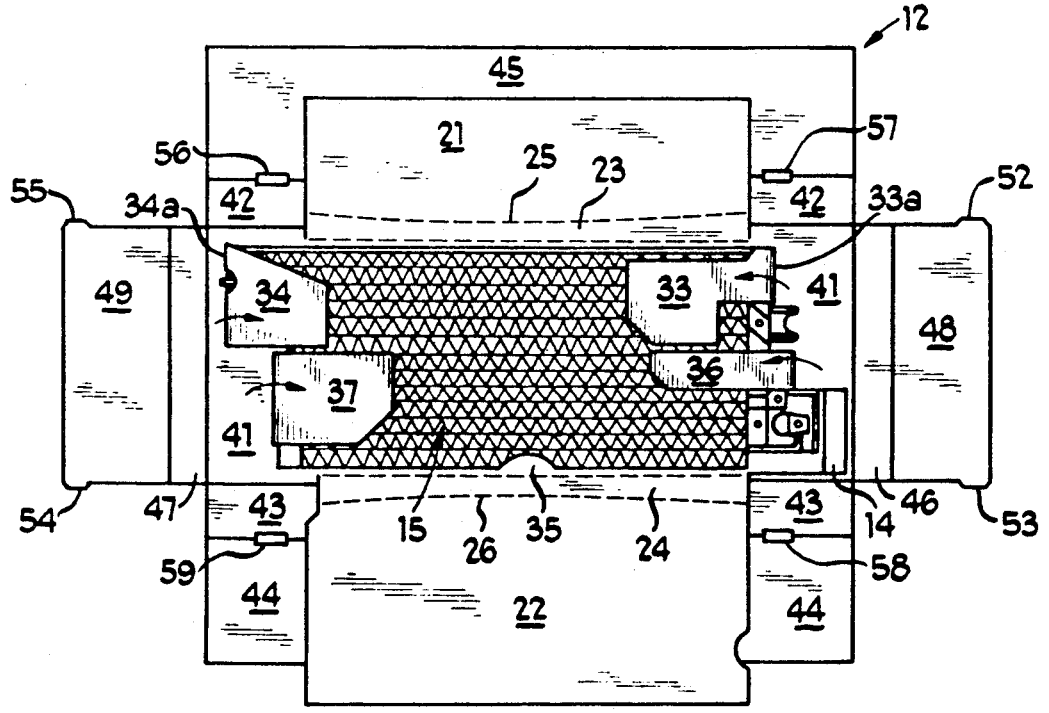
FIG. 3 is a top plan view of the article stabilizing container apparatus of FIG. 2 in which the front and back wall means as well as the front and back lid means of the inner article containment means are folded inwardly to secure the placement of the article.

FIG. 3 shows the beginning deployment and articulation of inner article containment means 20 about automotive condenser article 15. Front and back wall means 31, 39, 32 and 37 of inner article containment means 20, as well as, front and back lid means 33, 36, 34 and 37, are folded inwardly towards and about automotive condenser 15 so as to better conform to the perimeter of the non-uniformly shaped automotive article 15. Top wall means 21 and 22, as well as, side wall means 23 and 24 are still overlapping cover panel means 45 and 44 and side panel means 42 and 43 as well as being substantially co-planar with platform 35, with top wall fold means 25 and 26, as well as side edges 23*a* still substantially unfolded.

Figure 4:
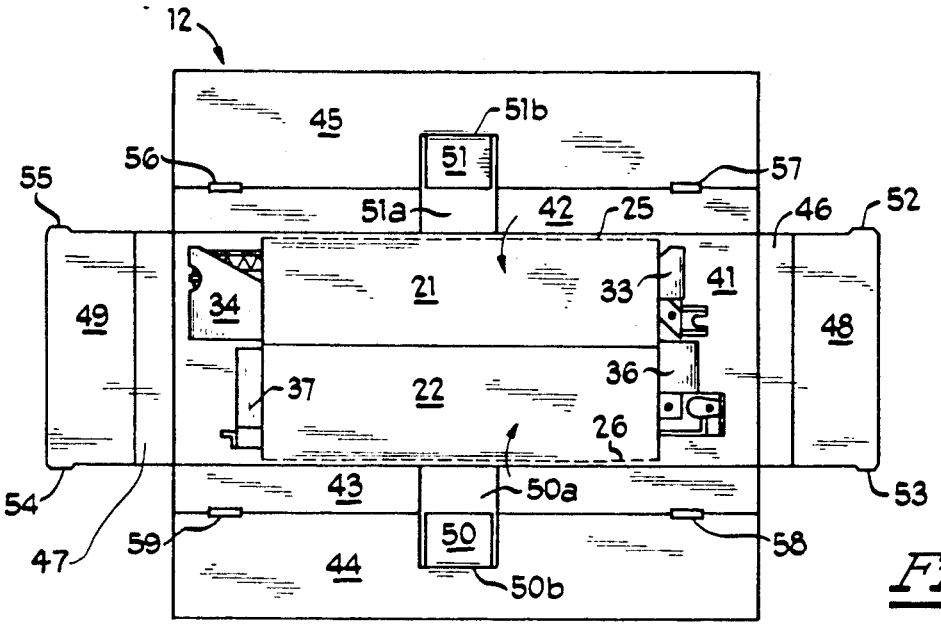
FIG. 4 of the drawings is a top plan view of the article stabilizing container apparatus of FIG. 3, in which the side wall and top wall means, as well as the front and back wall means and front and back lid means of the inner article containment means, are all folded inwardly while the inner article containment means is positioned within the outer articulatable container means and encasing the article.

Inner article containment means 20 is fully deployed around automotive condenser article 15 so as to securely restrain condenser 15 within the apparatus 12 in FIG. 4. Top wall means 21 and 22 are folded inwardly towards condenser 15 along substantially curvilinear shaped top wall fold means 25 and 26, so as to provide a narrowing of side wall means 23 and 24 and therefore effectuate a crimping action about the center of automotive condenser article 15. Front and back lid means 33, 36, 37 and 34 protrude beyond the edges of top wall means 21 and 22 but still conform to the non-uniform shape of automotive condenser article 15. Inner article containment means 20 now fits completely within the perimeter formed by the front and back and side edges of bottom panel means 41. Bottom panel means 41, side panel means 42 and 43, cover panel means 45 and 44, front and back panel means 46 and 47, front and back closure flap means 48 and 49 as well as bearing flap means 51 and 50 are still all substantially co-planar to each other and parallel to platform 35, prior to articulation.

Figure 5:
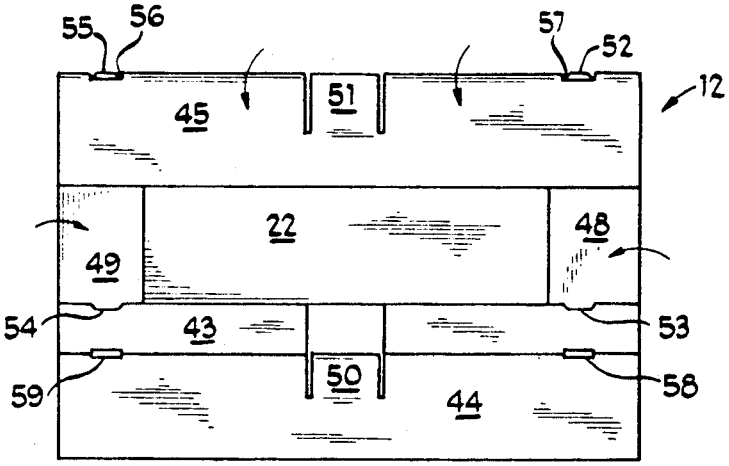
FIG. 5 is the top plan view of the apparatus shown in FIG. 4, wherein all but one of the side panel, cover panel and front and back panel means of the outer articulatable container means have been closed about the inner article containment means.

The initial deployment and articulation of outer articulatable container means 40 is shown in FIG. 5. Front and back flap closure means 48 and 49 are folded inwardly towards inner article containment means 20 so as to be substantially parallel to top wall means 22 and 21. Additionally, cover panel means 45 is also folded inwardly towards inner article containment means 20 so as to be substantially parallel to top wall means 22 and 21 and adjacent to front and back closure flap means 49 and 48. Upon folding cover panel means 45, securement aperture 56 and 57 are engaged by securement tabs 55 and 52 so as to lock front and back panel closure flap means 49 and 48 into their respective positions. Side panel means 43 and cover panel means 44, as well as bearing flap 50 remains unfolded so as to still be substantially co-planar with bottom panel means 41.

Figure 6:
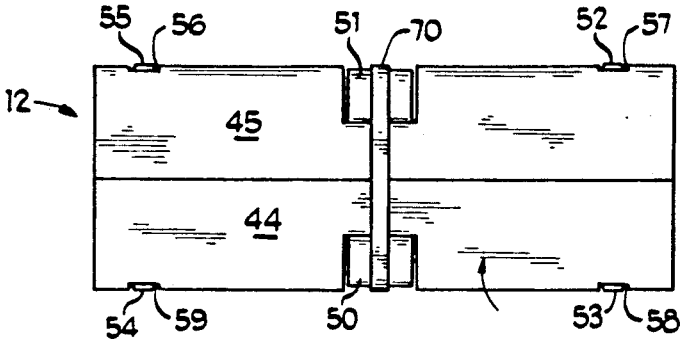
FIG. 6 is a top plan view of the fully articulated and deployed article stabilizing container apparatus wherein the cover panel means of the outer articulatable container means have been secured by outer container closure means operably engaging the bearing flap means of the outer articulatable container means.

Article stabilizing container apparatus 12 is shown as fully deployed and secured in FIG. 6. Cover panel means 45 and 44 are now fully folded and deployed about inner article containment means 20. Securement tabs 55, 52, 53 and 54 engage securement apertures 56, 57, 58 and 59 so as to secure front and back panel closure flap means about inner article containment means 20. Outer container closure means, here metallic strap band 70, is securely placed about outer articulatable container means 40 so as to operably engage bearing flap means 51 and 50. Upon this engagement, bearing flaps 51 and 50 exert a bearing force against side walls 23 and 24 and top walls 21 and 22 of inner container 20.

Figure 7:
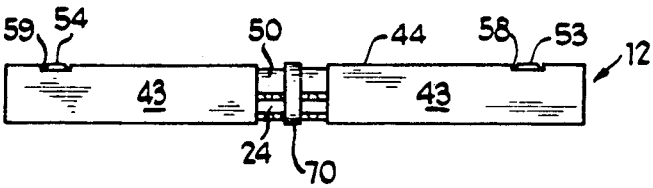
FIG. 7 is an elevated side view of the apparatus of FIG. 6 demonstrating the bearing flaps being operably engaged by the outer container closure means, to in turn, operably engage the inner article containment means.

FIG. 7 shows a side view of fully articulated and deployed article stabilizing container apparatus 12 wherein outer container closure strap 70 tightly engages bearing flap means 50 and 51 so that the pressure applied to bearing flap 50 is also applied to top wall means 21 and 22 and to side wall means 23 and 24. Additionally, securement tabs 53 and 54 can be seen engaging apertures 58 and 59, protruding past the perimeter edge of side panel means 43.

FIG. 8 shows first inner article containment means 90 comprising platform 91, side wall means 95 and 96, top wall means 92 and 93, front and back wall means 104, 105, 102 and 103, as well as front and back lid means 100, 101, 99 and 98. Side wall means 94 and 96 and front and back wall means 104, 105, 102 and 103 all hingedly emanate from platform means 91 at respective side, front and back edges. Similarly, top wall means 92 and 93 as well as front and back lid means 100, 101, 99 and 98 all hingedly emanate from respective side wall means 95 and 96 and front and back wall means 104, 105, 102 and 103. Top wall fold means 94 and 97, at which top wall means 92 and 93 hinge from side wall means 95 and 96, are again substantially curvilinear in shape so that upon closure of top wall means 92 and 93, side wall means 95 and 96 are narrower towards the center of inner article containment means 90—so as to crimp the position of the article therewithin.

Second inner article containment means 80 is shown in FIG. 9. Inner article containment means 80 comprises platform 81 which is shaped so as to work in combination with inner article containment means 90 of FIG. 8, to further receive and suspend a non-uniformly shaped article within article stabilizing container apparatus 75, with particular article spacing criteria. Platform 81 further contains glue strips 71 through 74 upon its top surface so that upon proper deployment, inner article containment means 90 is adhesively secured within apparatus 75.

FIG. 10 shows outer articulatable container means 115 as comprising bottom panel means 120, front and back panel means 127 and 128, side panel means 123 and 124, front and back closure flap means 126 and 125, cover panel means 121 and 122, as well as bearing flap means 129 and 130. Front and back closure flap means 125 and 126 further have securement tab means 135, 136, 137 and 138 for use in cooperation with securement apertures 131, 132, 133 and 134 positioned within side panel means 123 and 124 and cover panel means 121 and 122 upon full articulation and deployment. Glue strips 116 through 119 are positioned upon bottom panel means 120 so that upon assembly of apparatus 75, engagement of second inner article containment means 80 is secured, thereby securing first inner article containment means 90 and the article secured within.

Assembled apparatus 75 is shown in FIG. 11 prior to closure. Platform 81 of containment means 80 is placed within the perimeter of the edges of bottom panel means 120 of outer articulatable container means 115 so as to engage the glue strips 116, 117, 118 and 119. Inner article containment means 90 is then positioned upon platform 81 and within the perimeter of the edges of bottom panel means 120 so that apertures 108, 109, 106 and 107 of platform 91 are not blocked by platform 81. In this configuration, glue strips 71, 72, 73 and 74 engage the bottom surface of platform 91 so as to secure first inner article containment means 90 to second inner article containment means 80, and thereby secure first inner containment means 90 to outer articulatable container means 115. Prior to articulation, top wall means 92 and 93 overlap cover panel means 121 and 122 and side panel means 123 and 124. Similarly, front and back lid means 100, 101, 98 and 99 overlap front and back panel means 128 and 127 as well as front and back closure flap means 125 and 126. Prior to articulation, top wall means 92 and 93, side wall means 95 and 96 and front and back lid means 100, 101, 98 and 99 are all substantially unfolded and co-planar with platform 91. Likewise, cover panel means 121 and 122, side panel means 123 and 124, front and back panel means 128 and 127, as well as front and back closure flap means 125 and 126 are substantially unfolded and coplanar With bottom panel means 120. Additionally, platform 81, platform 91, and bottom panel means 120 are all substantially parallel to each other. Apparatus 75 may then be articulated about an article, as shown equivalently in FIGS. 3 through 6, to effectively restrain and secure an article in suspension—with a minimum of packing materials; most of which, but for the inner containment means, may be standardized regardless of the dimensions of varying article sizes. In this manner, for example, a shipper of condenser coils need only inventory differing inner containment members for his varying dimensioned condensers, with the outer container being standardized to reduce overall inventory requirements.

Alignment indicia means 60 through 64, here, embossed locator lines, are shown operably positioned upon the top surface of bottom wall means 41 as shown in FIG. 1. Acting as guidelines, alignment indicia means 60 through 64 help ensure that inner article containment means 20 is properly positioned immediately prior to attachment between the inner and outer elements so as to better facilitate the designed protection and suspension of condenser article 15 therewithin. While, alignment indicia means 60 through 64 may be embossed onto bottom wall means 41, it may likewise be formed by any other means, such as penciling, engraving or scoring.

The foregoing description and drawings merely explain and illustrate the invention and the invention is not limited thereto, except insofar as the appended claims are so limited, as one skilled in the art who has the disclosure before him/her will be able to make modifications and variations therein without departing from the scope of the invention.

What is claimed is:

1. An article stabilizing container apparatus for the facilitated envelopment and restraint of one or more non-uniformly shaped articles therewithin, towards the further sealed and protective enclosure of said one or more articles during transportation and storage, said apparatus comprising:

one or more inner article containment means for preliminarily restraining the position of one or more articles within said article stabilizing container apparatus, comprising at least a substantially planar platform having a top surface and a bottom surface opposite said top surface as well as one or more side edges and front and back edges, said platform being independently, restrainably attachable to said one or more articles and dimensioned to at least partially confine and restrain said one or more articles with at least a portion of said bottom surface being exposed;

outer articulatable container means for restrained receipt of said one or more inner article containment means and said one or more articles, having a bottom panel and one or more cover panels opposite said bottom panel, as well as one or more side panels emanating from said bottom panel, said bottom panel of said outer articulatable container means having a top surface and a bottom surface, and at least one or more side edges from which said one or more side panels foldably emanate respectively, said one or more side panels of said outer articulatable container means each having an upper edge and a lower edge, said lower edge of at least one of said one or more side panels being hingedly attached to and emanating from respective ones of said at least one or more side edges of said bottom panel of said outer articulatable container means, by one or more panel folds, said one or more cover panels of said outer articulatable container means hingedly emanating from one or more of said upper edges of said one or more side panels of said outer articulatable container means by one or more cover panel folds, said exposed portion of said bottom surface of said platform of said one or more inner article containment means being operably and restrainably attached to said top surface of said bottom panel of said outer articulatable container means by container attachment means for restraining the position of said one or more inner article containment means and said one or more articles relative to said outer articulatable container means so that said one or more articles restrained by said one or more inner article containment means are restrainably suspended within said outer articulatable container means to preclude vertical and horizontal movement of said one or more articles positioned therewithin;

outer container closure means for fixedly restraining the position of said bottom panel, said one or more cover panels and said one or more side panels of said outer articulatable container means substantially about said one or more inner article containment means and said one or more articles being confined and restrained therewithin to maintain said one or more articles in a suspended position therewithin, and preclude shifting of said one or more articles in either said vertical or horizontal directions; and said outer articulatable container means further including bearing flap means for restrainably maintaining the relative positions of said one or more inner article containment means and said one or more articles therewithin said one or more inner article containment means and said outer articulatable container means, said bearing flap means being operably positioned within one or more of said side and cover panels to hingedly apply bearing pressure directly against a portion of at least one of said one or more inner article containment means and said one or more articles, as a result of forces transmitted thereto by said outer container closure means, for further fixedly restraining said positions of said one or more inner article containment means and said one or more articles, collectively positioned within said outer articulatable container means.

2. The invention according to claim 1 in which the article stabilizing container apparatus further comprises:

a front panel and a back panel positioned opposite to said front panel, said front and back panels hingedly emanating from a respective front and back edge of said bottom panel of said outer articulatable container means, one or more of said front and back panels of said outer articulatable container means having a respective upper edge;

front and back panel closure flaps hingedly emanating inwardly respectively from said upper edges of said one or more front and back panels of said outer articulatable container means to further cover said one or more inner article containment means and said one or more articles upon articulation of said outer articulatable container means to further enclose and secure the position of said one or more inner article containment means and said one or more articles therewithin; and front and back panel securement means for fixedly restraining the position of said front and back panel closure flaps of said outer articulatable container means over said one or more inner article containment means and said one or more articles, said front and back panel closure flaps cooperating with said one or more cover panels of said outer article container means to substantially restrain and fully enclose said one or more inner article containment means and said one or more articles therewithin said outer articulatable container means.

3. The invention according to claim 2 wherein said front and back panel securement means comprises one or more securement tabs operably positioned upon and emanating outwardly from each of said front and back closure flaps respectively of said outer articulatable container means, with one or more securement apertures operably aligned for co-operation with said one or more securement tabs respectively, said one or more securement apertures being operably positioned in one or more of said side and cover panels of said outer articulatable container means, for receipt of said respective one or more securement tabs.

4. The invention according to claim 1 in which said one or more inner article containment means further comprises:

one or more side walls hingedly emanating respectively from said one or more side edges of said one or more inner article containment means, said one or more side walls of said one or more inner article containment means including a respective upper edge; and one or more top walls hingedly emanating respectively from said upper edge of said one or more side walls of said one or more inner article containment means by top wall folds, said one or more top walls capable of covering at least a portion of said one or more articles to further restrain said one or more articles therewithin said one or more inner article containment means;

one or more front and back walls emanating from said front and back edges respectively, said front and back walls being particularly shaped to encircle and restrain the front and back peripheral edges of said one or more non-uniformly shaped articles to further restrain said one or more articles within said one or more inner article containment means; and front and back lids hingedly emanating from one or more of said front and back walls respectively, along respective front and back lid folds, said bearing flap means of said outer articulatable container means operably positioned within one or both of said side and cover panels to hingedly apply bearing pressure directly against one or more of said side, top, front and back walls as a result of forces transmitted thereto by said outer container closure means, for further fixedly restraining said positions of all said panels walls and said one or more articles positioned therewithin.

5. The invention according to claim 4 wherein said one or more inner article containment means comprises a single inner article containment member, said one or more side walls comprising two side wall members emanating from opposite sides of said planar platform to enclose at least a portion of said one or more articles;

said one or more top walls comprising two top wall members to enclose at least said portion of said one or more articles to further restrain said one or more articles therewithin said inner article containment means.

6. The invention according to claim 5 in which said outer articulatable container means includes a front panel and a back panel positioned opposite to said front panel, said front and back panels hingedly emanating from a respective front and back edge of said bottom panel of said outer articulatable container means, said front panel and back panel of said outer articulatable container means each having a respective upper edge;

front and back panel closure flaps hingedly emanating inwardly respectively from said respective upper edges of both said front and back panels of said outer articulatable container means to further cover said one or more inner article containment means and said one or more articles upon articulation of said outer articulatable container means to further enclose and secure the position of said one or more inner article containment means and said one or more articles positioned therewithin;

front and back panel securement means for fixedly restraining the position of said front and back panel closure flap means of said outer articulatable container means over said one or more inner article containment means and said one or more articles, said front and back panel closure flaps co-operating with said one or more cover panel of said outer article container means to substantially restrain and fully enclose said inner article containment means and said one or more articles therewithin said outer articulatable container means, said one or more cover panels of said outer articulatable container means comprising two cover panels positioned opposite to each other and substantially parallel to said two top wall members upon articulation and closure of said outer articulatable container means to enclose said inner article containment means and said one or more articles therewithin said outer articulatable container means whereby said inner article containment means and said one or more articles are substantially restrained and enclosed by said outer articulatable container means, said outer container closure means operably positioned about said bearing flap means of said two cover panels of said outer articulatable container means to direct said bearing flap means and said two cover panels into operable engagement with said two side and two top walls of said inner article containment means thereby securing and stabilizing said one or more articles suspended within said inner article containment means.

7. The invention according to claim 6 wherein said outer articulatable container closure means comprises a band member wrapped about said outer articulatable container means so as to operably engage said bearing flap means to operably prompt said side and cover panels of said outer articulatable container means into operable restraining engagement with said side and top walls of said inner article containment means.

8. The invention according to claim 7 in which said band member of said container closure means comprises a metallic strap wrapped about said outer articulatable container means so as to operably engage said bearing flap means.

9. The invention according to claim 4 wherein said top wall folds of said one or more inner article containment means are substantially curvilinear in shape to create side walls substantially narrower at the center of said one or more articles and wider at the ends of said one or more articles to prompt a crimping action by said side and top walls about said one or more articles at a position proximate to said center by more closely conforming the shape of said one or more inner article containment means at said center to the outer peripheral shape of said one or more articles at said center, so as to provide greater securement of said one or more articles;

said outer container closure means of said apparatus being applied about said center of said one or more articles so as to more effectively prompt said crimping action.

10. The invention according to claim 4 wherein said one or more inner article containment means substantially conforms closely to the outer peripheral shape of said one or more articles so as to provide greater securement and stabilization of said one or more articles suspended therewithin.

11. The invention according to claim 1 wherein said one or more inner article containment means and said outer articulatable container means are fabricated of a paperboard material.

12. The invention according to claim 11 in which said paperboard material comprises corrugated paperboard.

13. The invention according to claim 11 in which each of said one or more inner article containment means and said outer articulatable container means are formed by separate, respective articulatable blanks of said paperboard material.

14. The invention according to claim 1 in which said container attachment means for attaching said bottom surface of said platform of said one or more inner article containment means to said top surface of said bottom panel of said outer articulatable container comprises an adhesive substance.

15. The invention according to claim 1 in which said one or more inner article containment means comprises a first and second inner article containment member including a first and second substantially planar platform member respectively, each having a top surface and a bottom surface, said planar platform member of said first inner article containment member being attached by adhesion means at said top surface to said bottom surface of said planar platform member of said second inner article containment means, said bottom surface of said planar platform member of said first inner article containment means being restrainably attached by adhesion means to said top surface of said bottom panel of said outer articulatable container means to restrainably maintain both said first and said inner article containment means restrainably positioned relative to said outer articulatable container means to restrainably secure said one or more articles positioned therewithin, both said first and second inner article containment members accommodating and stabilizing portions of said one or more non-uniformly shaped articles therewithin to preclude damage to and shifting of said one or more articles in either the vertical or horizontal directions, therewithin said article stabilizing container apparatus.

16. The invention according to claim 1 in which at least one of said outer articulatable container means and said one or more inner article containment means further comprises an alignment indicia member, said alignment indicia member being operably positioned upon a portion of at least one of said outer articulatable container means and said one or more inner article containment means so as to ensure proper positioning and alignment of each upon engagement of said container attachment means to adequately co-operate with and protect the one or more articles positioned therewithin.

* * * * *

UNITED STATES PATENT AND TRADEMARK OFFICE

CERTIFICATE OF CORRECTION

PATENT NO. : 5,127,525

DATED : July 7, 1992

INVENTOR(S) : Katherine M. Hummer

It is certified that error appears in the above-identified patent and that said Letters Patent is hereby corrected as shown below:

| | |
|---|---|
| Column 11, Line 10 | "more panel folds" should read instead -- more side panel folds -- |

Signed and Sealed this

Third Day of August, 1993

*Attest:*

Michael K. Kirk

MICHAEL K. KIRK

*Attesting Officer*

*Acting Commissioner of Patents and Trademarks*